US009581399B2

(12) United States Patent
Lee et al.

(10) Patent No.: US 9,581,399 B2
(45) Date of Patent: Feb. 28, 2017

(54) HEAT EXCHANGER WASHING DEVICE AND AIR CONDITIONER HAVING THE SAME

(75) Inventors: Chan Hee Lee, Suwon-si (KR); Young Kwang Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 748 days.

(21) Appl. No.: 13/337,932

(22) Filed: Dec. 27, 2011

(65) Prior Publication Data

US 2012/0168124 A1 Jul. 5, 2012

(30) Foreign Application Priority Data

Dec. 29, 2010 (KR) ..... 10-2010-0138120

(51) Int. Cl.
*F28G 9/00* (2006.01)
*F28G 1/16* (2006.01)

(52) U.S. Cl.
CPC ..... *F28G 9/00* (2013.01); *F28G 1/166* (2013.01)

(58) Field of Classification Search
CPC ..... F28G 9/00
See application file for complete search history.

(56) References Cited

U.S. PATENT DOCUMENTS 5,499,643 A * 3/1996 Vincent et al. ..... 134/104.4

FOREIGN PATENT DOCUMENTS

| | | | |
|---|---|---|---|
| CN | 86 1 07449 | | 5/1987 |
| DE | 20 2008 001 689 | U1 | 5/2008 |
| DE | 10 2007 040 427 | A1 | 2/2009 |
| EP | 1 508 764 | A2 | 2/2005 |
| JP | 2007-178096 | | 7/2007 |
| KR | 10-2004-0080873 | | 9/2004 |
| WO | WO 2005/037585 | A1 | 4/2005 |
| WO | WO 2010/133932 | A1 | 11/2010 |

OTHER PUBLICATIONS

Chinese Office Action issued Dec. 1, 2014 in corresponding Chinese Patent Application No. 201110460449.2.

* cited by examiner

*Primary Examiner* — Jason Ko
(74) *Attorney, Agent, or Firm* — Staas & Halsey LLP

(57) ABSTRACT

A heat exchanger washing device includes a wash water storage chamber to store wash water in a case, a wash water injection chamber to jet the wash water stored in the wash water storage chamber to a heat exchanger, and a bypass path unit to guide the wash water jetted from the wash water injection chamber to a side surface of the heat exchanger after bypassing an upper surface of the heat exchanger.

16 Claims, 9 Drawing Sheets

HEAT EXCHANGER WASHING DEVICE AND AIR CONDITIONER HAVING THE SAME

CROSS-REFERENCE TO RELATED APPLICATIONS

This application claims the benefit of Korean Patent Application No. 10-2010-138120 filed on Dec. 29, 2010 in the Korean Intellectual Property Office, the disclosure of which is incorporated herein by reference.

BACKGROUND

1. Field

Embodiments of the present disclosure relate to an air conditioner equipped with an improved device for cleaning a heat exchanger.

2. Description of the Related Art

An air conditioner is a system configured to control heat and humidity of ambient air. Heat exchange of such an air conditioner with ambient air is achieved by a simple refrigeration cycle.

The refrigeration cycle may include a compressor, a condenser, an expansion valve, and an evaporator. High-temperature and high-pressure refrigerant emerging from the compressor exchanges heat with outdoor air while passing through the condenser, so that it is changed into a low-temperature state. The refrigerant is then changed into a low-temperature and low-pressure state while passing through the expansion valve. The low-temperature and low-pressure refrigerant subsequently exchanges heat with indoor air while passing through the evaporator, so that the indoor air is cooled.

Heat exchangers are classified into vehicle heat and domestic heat exchangers in accordance with the installation place thereof. The vehicle heat exchanger and the domestic heat exchanger differ in terms of the kind of refrigerant used therein and the operation environments of the installation place thereof such as air flow and air velocity. For this reason, these heat exchangers have different design factors in terms of material and size, in order to obtain optimal heat exchange efficiencies.

SUMMARY

Therefore, it is an aspect of the present disclosure to provide an air conditioner capable of improving a wash water injection structure of a heat exchanger, thereby achieving an enhancement in the washing performance of the heat exchanger.

Additional aspects of the disclosure will be set forth in part in the description which follows and, in part, will be apparent from the description, or may be learned by practice of the disclosure.

In accordance with one aspect of the present disclosure, a heat exchanger washing device to clean a heat exchanger includes a case, a wash water storage chamber to store wash water in the case, a wash water injection chamber to jet the wash water stored in the wash water storage chamber to the heat exchanger, and a bypass path unit to guide the wash water jetted from the wash water injection chamber to a side surface of the heat exchanger after bypassing an upper surface of the heat exchanger.

The heat exchanger may include a heat exchange unit to allow refrigerant to exchange heat with air, and a header unit to supply the heat exchange unit with the refrigerant. The upper surface of the heat exchanger may correspond to an upper surface of the header unit, and the side surface of the heat exchanger may correspond to a side surface of the header unit.

The case may be located above the heat exchanger.

The case may include a first case and a second case, which are coupled to each other, to define a certain space in the case.

At least one first partition member to divide the wash water storage chamber and at least one second partition member to divide the wash water injection chamber may be formed in the case.

The first partition member may be protruded from the first case, and an upper end of the first partition member may be spaced apart from the second case.

The second partition member may be protruded from the first case, and wash water nozzles may be formed at a lower end of the second partition member.

An end of the bypass path unit may be located at the side surface of the heat exchanger.

The bypass path unit may include a first bypass path portion extending to the side surface of the heat exchanger after bypassing the upper surface of the heat exchanger, and a second bypass path portion spaced apart from the first bypass path portion by a predetermined clearance.

A plurality of flow guide portions may be formed at the first bypass path portion to guide the wash water.

The heat exchanger washing device may further include a water supply unit to supply the wash water storage chamber with the wash water.

The water supply unit may include a pump, a connecting hose to pass the wash water pumped by the pump, and a water supply member connected to the connecting hose to supply the wash water storage chamber with the wash water.

The heat exchanger washing device may further include a dispersion member to disperse the wash water supplied through the water supply member, in order to store the wash water in the wash water storage chamber.

The water supply member may be formed at the first case, and the dispersion member may be formed in the second case and arranged above the water supply member.

The heat exchange unit may include a plurality of fins and tubes.

In accordance with another aspect of the present disclosure, a heat exchanger washing device to clean a heat exchanger includes a case, a wash water storage chamber to store wash water up to a predetermined level in the case, a wash water injection chamber to jet the wash water stored in the wash water storage chamber to the heat exchanger, and a bypass path unit to allow the wash water jetted from the wash water injection chamber to bypass at least one barrier arranged at an upper side of the heat exchanger.

In accordance with a further aspect of the present disclosure, an air conditioner includes a cabinet, a heat exchanger arranged in the cabinet, a blast fan to blow air towards the heat exchanger, and a heat exchanger washing device to clean a heat exchanger, wherein the heat exchanger washing device includes a bypass path unit to allow wash water to be jetted to a side surface of the heat exchanger after bypassing an upper surface of the heat exchanger.

The heat exchanger may include a heat exchange unit, a first header unit arranged at a lower side of the heat exchange unit, and a second header unit arranged at an upper side of the heat exchange unit. The upper surface of the heat exchanger may correspond to an upper surface of the second header unit, and the side surface of the heat exchanger may correspond to a side surface of the second header unit.

The heat exchanger may include a heat exchange unit, a first header unit arranged at a lower side of the heat exchange unit, and a second header unit arranged at an upper side of the heat exchange unit. The upper surface of the heat exchanger may correspond to an upper surface of the second header unit, and the side surface of the heat exchanger may correspond to a surface of the heat exchange unit.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
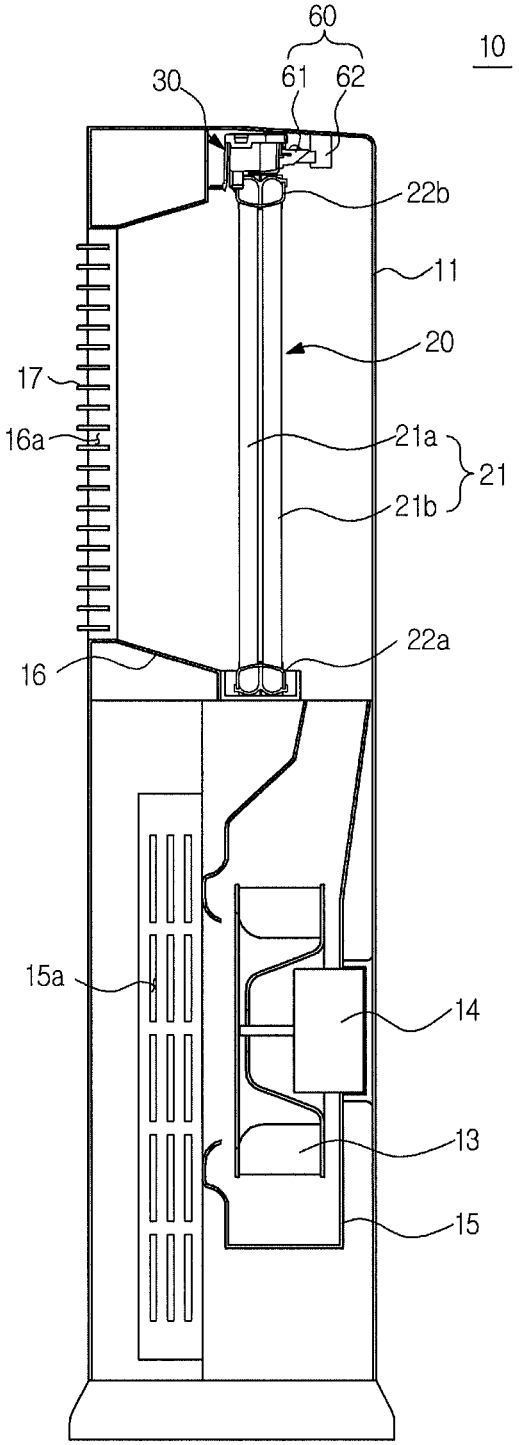
FIG. 1 is a sectional view illustrating an air conditioner according to an exemplary embodiment of the present disclosure.

Reference will now be made in detail to the embodiments of the present disclosure, examples of which are illustrated in the accompanying drawings, wherein like reference numerals refer to like elements throughout.

Hereinafter, an air conditioner according to an exemplary embodiment of the present disclosure will be described with reference to the accompanying drawings.

FIG. 1 is a sectional view illustrating an air conditioner according to an exemplary embodiment of the present disclosure.

As shown in FIG. 1, the air conditioner 10 may include a cabinet 11, a heat exchanger 20, a blast fan 13, a driving motor 14, an intake duct 15, an exhaust duct 16, and a heat exchanger washing device 30.

A suction portion 15*a* through which indoor air flows into the cabinet 11, and a discharge portion 16*a* through which heat-exchanged air flows out into an interior space are formed on an outer surface of the cabinet 11. In particular, blades 17 are installed at the discharge portion 16*a* to change a flow direction of air discharged from the discharge portion 16*a*, and thus to allow the heat-exchanged air to be evenly spread throughout the interior space.

Internal components of the air conditioner are installed in the cabinet 11. That is, examples of such an internal component include the heat exchanger 20, the blast fan 13, the driving motor 14, the intake duct 15, the exhaust duct 16, etc. The heat exchanger 20 allows refrigerant to exchange heat with air, the blast fan 13 blows air towards the heat exchanger 20, the driving motor 14 drives the blast fan 13, the intake duct 15 is arranged at an intake side of the blast fan 13, and the exhaust duct 16 is arranged at an exhaust side of the blast fan 13.

The heat exchanger 20, which is made of an aluminum material, is formed through a brazing process. The heat exchanger 20 may include a heat exchange unit 21 and a header unit 22*a*, 22*b*. The heat exchange unit 21 may include a first heat exchange unit 21*a* and a second heat exchange unit 21*b*, which are layered in a shorter axis direction of the heat exchanger 20. On the other hand, the header unit 22*a*, 22*b* may include a first header unit 22*a* arranged at a lower side of the heat exchange unit 21, and a second header unit 22*b* arranged at an upper side of the heat exchange unit 21.

The heat exchange unit 21 includes a plurality of tubes and fins. In such a heat exchange unit 21, refrigerant flowing inside the tubes exchanges heat with air flowing outside the tubes. Each of the fins is coupled between the adjacent tubes to achieve an enhancement in heat exchange efficiency. Also, such a heat exchange unit 21 is vertically installed.

Refrigerant inflow tubes 23 are connected to one side of the first header unit 22*a* to supply the first heat exchange unit 21*a* with refrigerant. The refrigerant, which flows into the first heat exchange unit 21, is returned to the first header unit 22*a* again, after passing through the second header unit 22*b* and subsequently circulating through the second heat exchange unit 21*b*. On the other hand, a refrigerant outflow tube 24 is connected to the other side of the first header unit 22*a* to discharge the refrigerant from the refrigerant outflow tube 24.

The blast fan 13 blows air towards the heat exchanger 20. When the blast fan 13 operates by the driving motor 14, air flowing into the suction portion 15*a* is guided by the intake duct 15 to flow into the blast fan 13, and is then guided by the exhaust duct 16 to pass through the heat exchanger 20 and to subsequently flow out through the discharge portion 16*a*.

The heat exchanger washing device 30 performs a function for cleaning the heat exchanger 20. Condensed water is generated and subsequently gathered on a surface of the heat exchanger 20 during the operation of the heat exchanger 20. In this case, bacteria may be likely to grow within the condensed water gathered on a surface of the heat exchanger 20. Further, corrosion on the surface of the heat exchanger 20 may result from the condensed water. Therefore, the heat exchanger washing device 30 removes the condensed water, and thus may achieve an enhancement in the efficiency of the heat exchanger 20.

Figure 2:
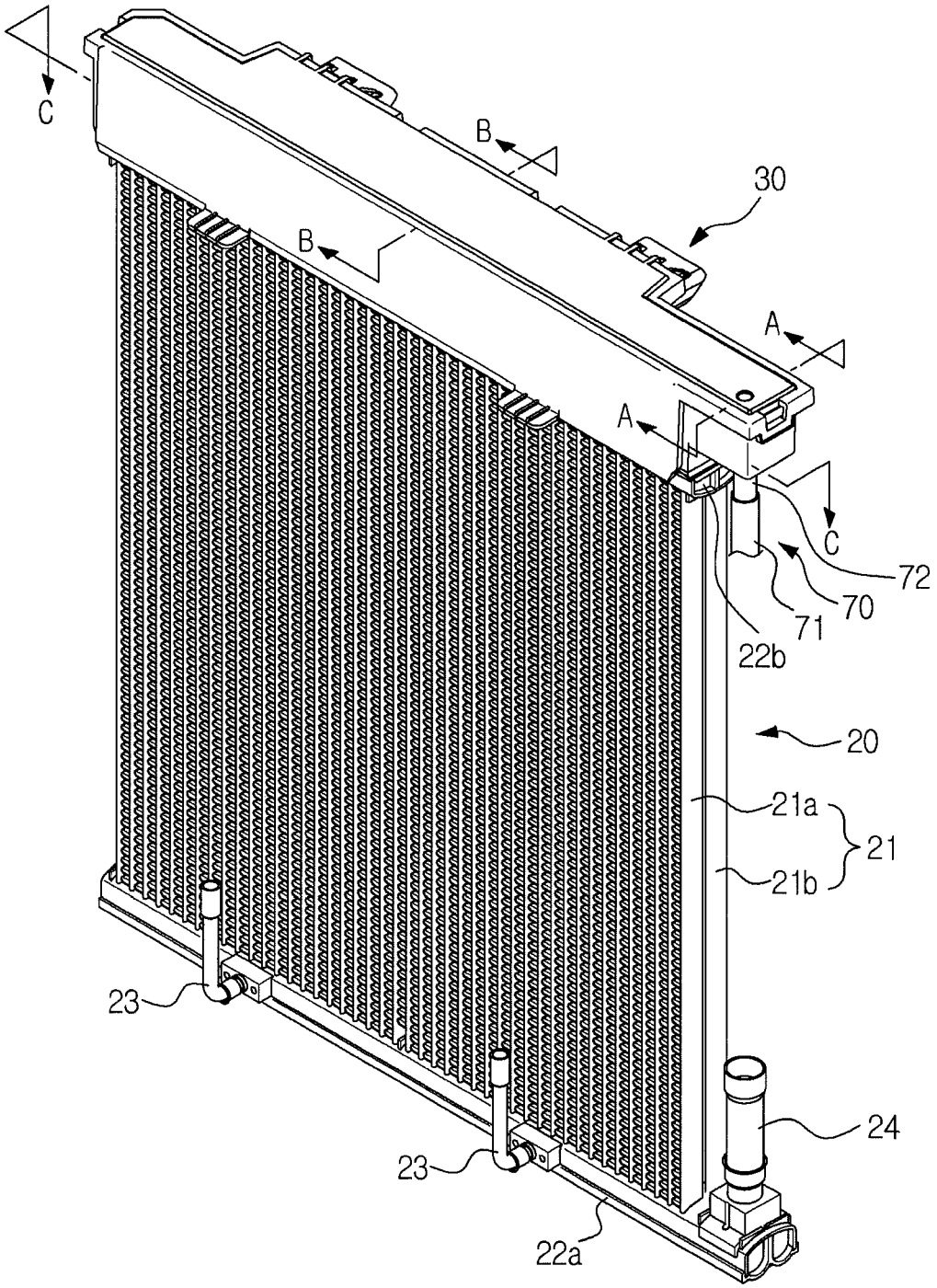
FIG. 2 is a coupled perspective view illustrating a heat exchanger washing device according to an exemplary embodiment of the present disclosure.
Figure 3:
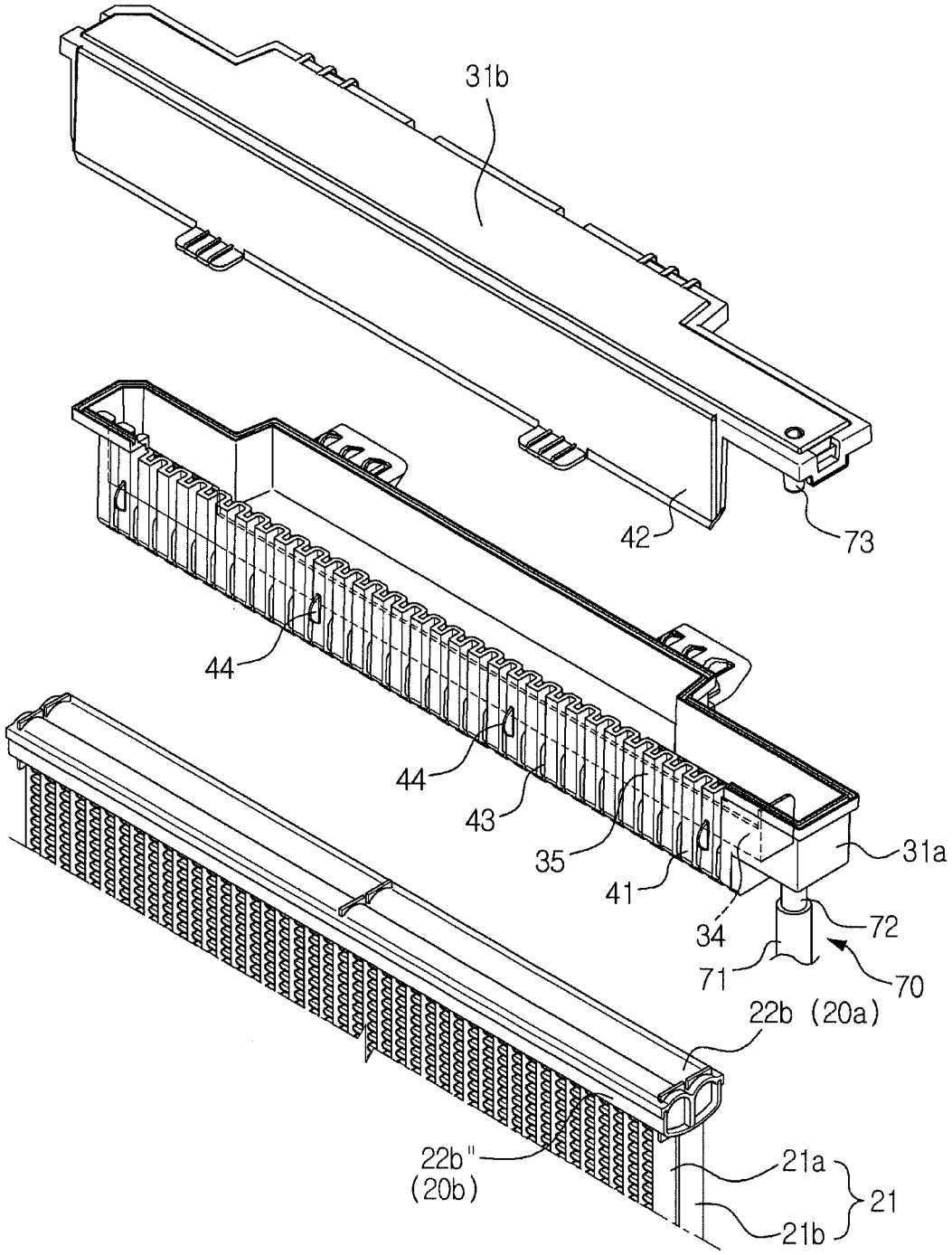
FIG. 3 is an exploded perspective view illustrating the heat exchanger washing device according to the illustrated embodiment of the present disclosure.
Figure 4:
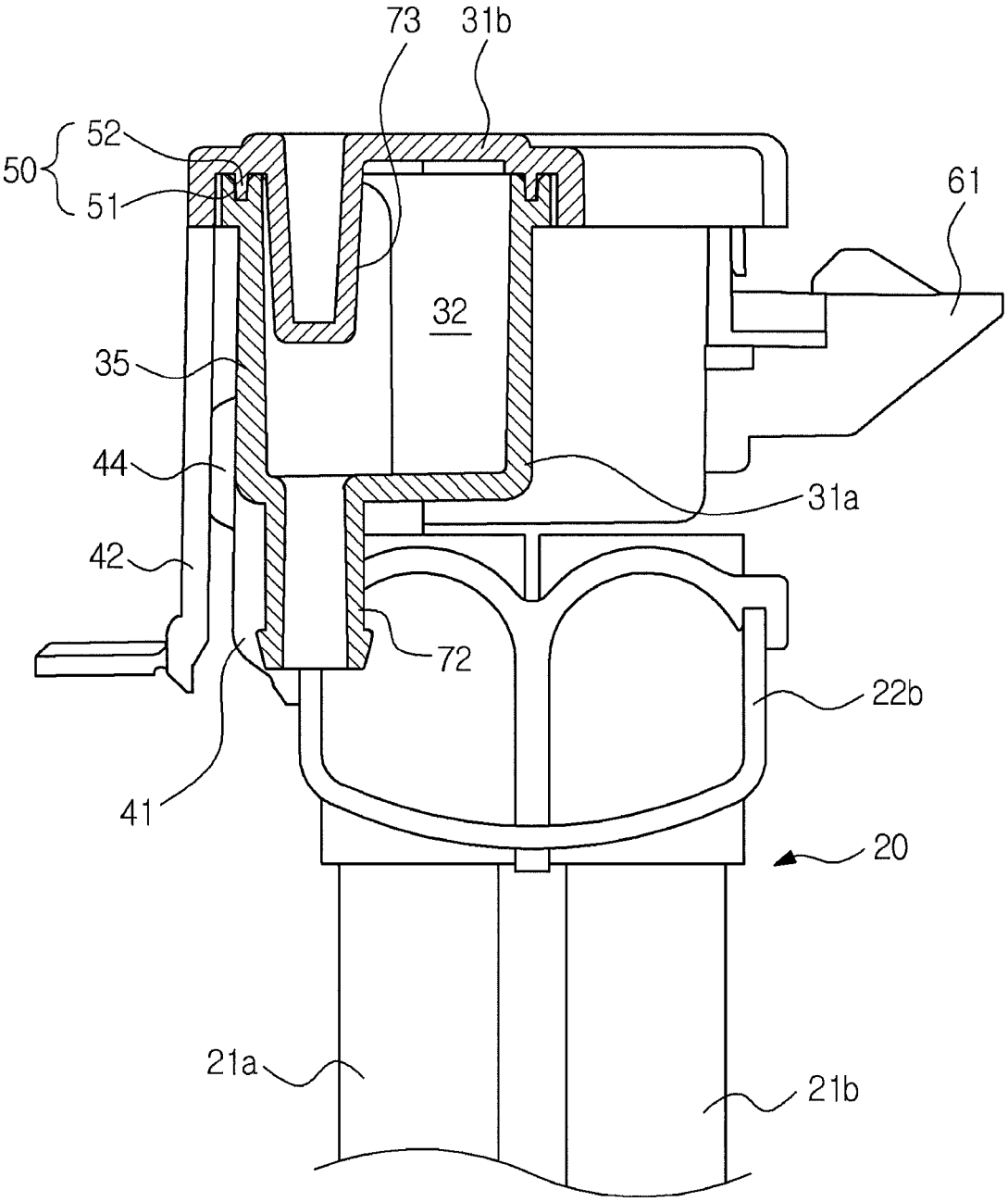
FIG. 4 is a sectional view taken along line A-A of FIG. 2.
Figure 5:
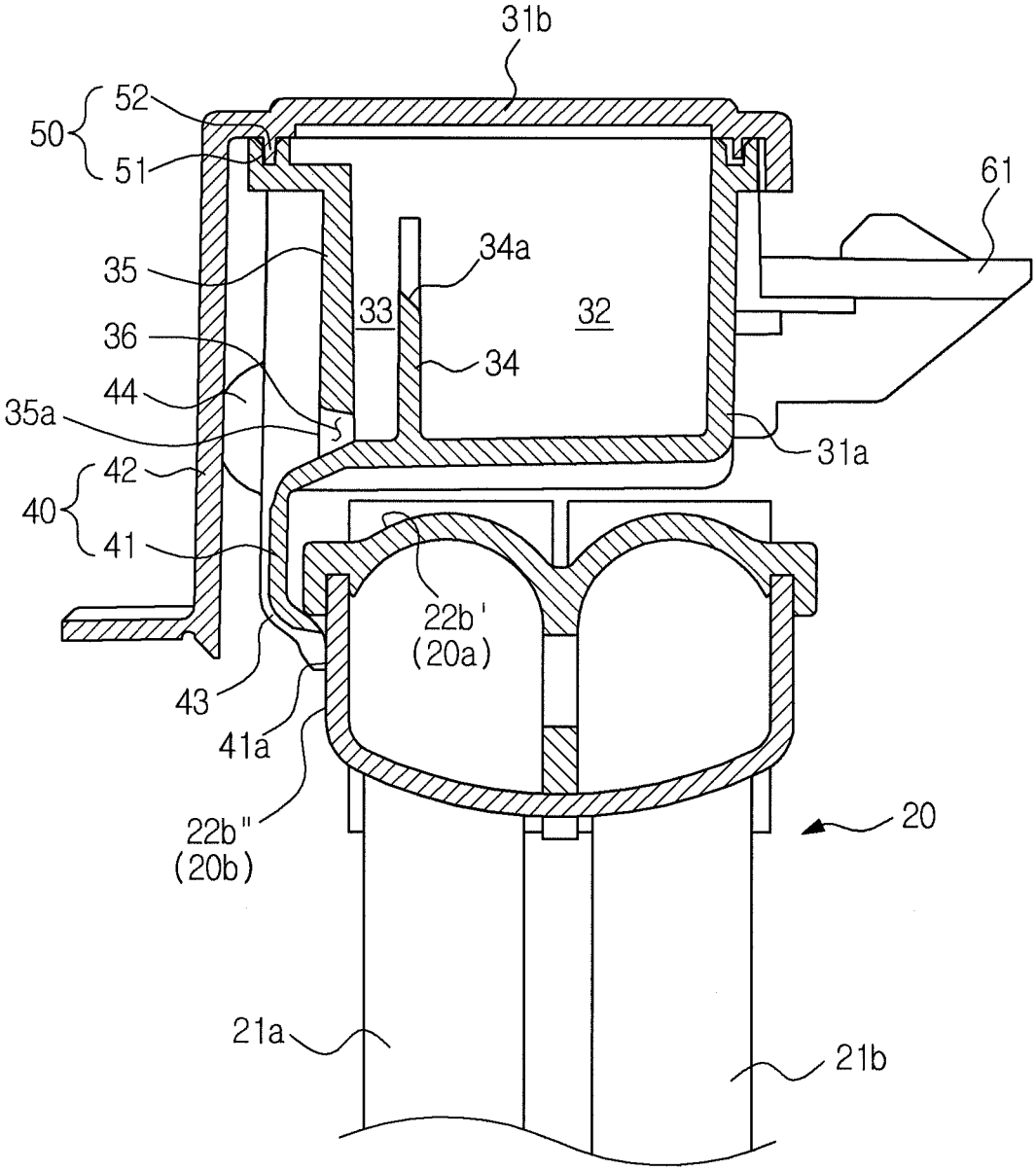
FIG. 5 is a sectional view taken along line B-B of FIG. 2.
Figure 6:
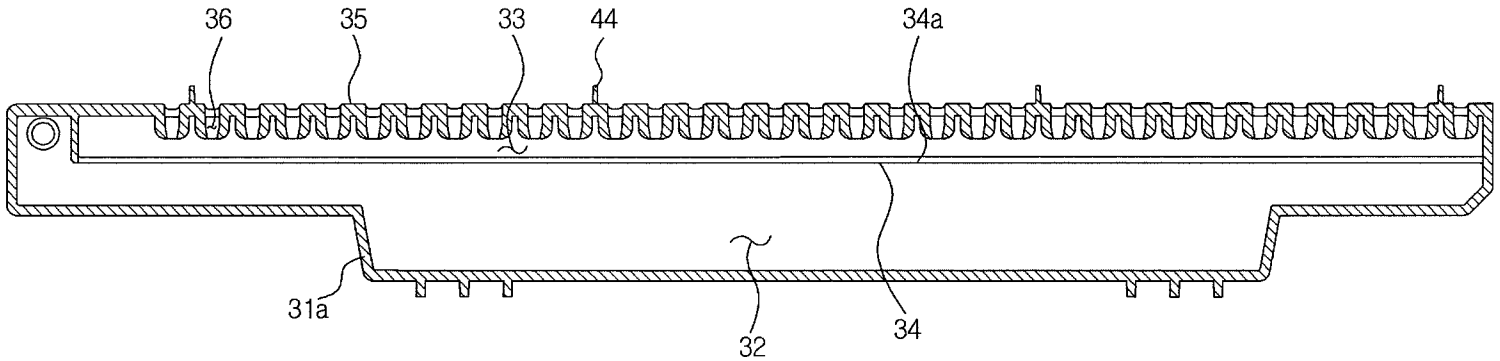
FIG. 6 is a sectional view taken along line C-C of FIG. 2.

FIG. 2 is a coupled perspective view illustrating the heat exchanger washing device according to an exemplary embodiment of the present disclosure. FIG. 3 is an exploded perspective view illustrating the heat exchanger washing device according to the illustrated embodiment of the present disclosure. FIG. 4 is a sectional view taken along line A-A of FIG. 2. FIG. 5 is a sectional view taken along line B-B of FIG. 2. FIG. 6 is a sectional view taken along line C-C of FIG. 2.

As shown in FIGS. 1 to 6, the heat exchanger washing device 30 may include a case 31*a*, 31*b*, a wash water storage chamber 32, a wash water injection chamber 33, a bypass path unit 40, and a water supply unit 70.

The case 31*a*, 31*b* may include a first case 31*a* and a second case 31*b*. The first case 31*a* is arranged at a lower position, whereas the second case 31*b* is arranged at an upper position. The first case 31*a* and the second case 31*b* are coupled to each other by at least one first fastening unit 50. The first fastening unit 50 may include a first fastening portion 51 provided at the first case 31*a*, and a second fastening portion 52 provided at the second case 31*b*. In accordance with such a structure of the case 31*a*, 31*b*, a certain space may be defined in the case 31*a*, 31*b*.

The case 31*a*, 31*b* is coupled to the cabinet 11 by at least one second fastening unit 60. The second fastening unit 60 may include a first fastening portion 61 protruded from the first case 31*a*, and a second fastening portion 62 (see FIG. 1) corresponding to the first fastening portion 61 and provided at the cabinet 11.

The case 31*a*, 31*b* is located above the heat exchanger 20. In detail, the case 31*a*, 31*b* is located above the second header unit 22*b*. In this case, the second header unit 22*b* may function as a barrier preventing wash water jetted from the case 31*a*, 31*b* from being directly supplied to the heat exchanger 20. Accordingly, the heat exchanger washing device 30 may supply the wash water while bypassing the barrier.

Meanwhile, another barrier may be also provided between the case 31*a*, 31*b* and the heat exchanger 20. Similarly, the heat exchanger washing device 30 may supply the wash water while bypassing the barrier.

The wash water storage chamber 32 and the wash water injection chamber 33 are provided in the case 31*a*, 31*b*. A first partition member 34 and a second partition member 35 are formed in the case 31*a*, 31*b*. In the case 31*a*, 31*b*, a space divided by the first partition member 34 corresponds to the wash water storage chamber 32, whereas a space divided by the second partition member 35 corresponds to the wash water injection chamber 33. Here, the second partition member 35 may function as a side wall of the first case 31*a*.

The first partition member 34 is upwardly protruded from the first case 31*a*. Further, an upper end 34*a* of the first partition member 34 is spaced apart from the second case 31*b* so as not to come into contact with the second case 31*b*. As a result, the wash water stored in the wash water storage chamber 32 flows into the wash water injection chamber 33 over the first partition member 34.

The second partition member 35 is upwardly protruded from the first case 31*a*. Wash water nozzles 36 are formed at a lower end 35*a* of the second partition member 35. In this case, the wash water flows from the wash water storage chamber 32 to the wash water injection chamber 33 over the upper end 34*a* of the first partition member 34. The wash water flowing into the wash water injection chamber 33 is subsequently jetted through the wash water nozzles 36 formed at the lower end 35*a* of the second partition member 35.

The bypass path unit 40 allows the wash water jetted through the wash water nozzles 36 to bypasses at least a portion of the heat exchanger 20. That is, the wash water is supplied to a side surface 20*b* of the heat exchanger 20 after bypassing an upper surface 20*a* of the heat exchanger 20, in order to prevent the wash water from being directly supplied to the upper surface 20*a* of the heat exchanger 20. Here, the upper surface 20*a* of the heat exchanger 20 corresponds to an upper surface 22*b*' of the second header unit 22*b*, whereas the side surface 20*b* of the heat exchanger 20 corresponds to a side surface 22*b*" of the second header unit 22*b*. Alternatively, the side surface 20*b* of the heat exchanger 20 may correspond to a surface of the heat exchange unit 21.

The wash water, which is supplied to the side surface 20*b* of the heat exchanger 20, namely, the side surface 22*b*" of the second header unit 22*b*, subsequently free falls to the heat exchange unit 21, and then flows down along the fins and tubes of the heat exchange unit 21.

The bypass path unit 40 may include a first bypass path portion 41 and a second bypass path portion 42.

The first bypass path portion 41 extends downwardly from the first case 31*a*. In detail, the first bypass path portion 41 extends to the side surface 22*b*" of the second header unit 22*b* after bypassing the upper surface 22*b*' of the second header unit 22*b*. An end 41*a* of the first bypass path portion 41 is located on the side surface 22*b*" of the second header unit 22*b*. A plurality of flow guide portions 43 is formed at the first bypass path portion 41. Further, a plurality of flow guide portions 43 is formed along a longer axis direction of the heat exchanger 20. Thus, in accordance with the plural flow guide portions 43, the wash water may be evenly jetted throughout the longer axis direction of the heat exchanger 20.

The second bypass path portion 42 extends downwardly from the second case 31*b*. The second bypass path portion 42 is spaced apart from the first bypass path portion 41 by a predetermined clearance according to a separation member 44. As a result, the second bypass path portion 42 may block the wash water from being jetted through the wash water nozzles 36 in a direction away from the heat exchanger 20, and guide the wash water to the first bypass path portion 41.

Meanwhile, the water supply unit 70 may include a pump (not shown), a connecting hose 71, a water supply member 72, and a dispersion member 73.

The wash water storage chamber 32 is provided with the wash water supply member 72. The water supply member 72 is protruded from a bottom of the first case 31*a*, and is connected to the connecting hose 71. The connecting hose 71 is connected to the pump (not shown) pumping the wash water. Thus, the wash water is supplied to the wash water storage chamber 32 through the water supply member 72.

Further, the wash water storage chamber 32 is provided with the dispersion member 73. The dispersion member 73 is protruded from the second case 31*b* toward the water supply member 72. In this case, the wash water ejected from the water supply member 72 is dispersed by the dispersion member 73 to be stored in the wash water storage chamber 32. The wash water ejected from the water supply member 72 has a predetermined pressure or more as it is pumped by the pump (not shown), so that the wash water flows into the wash water storage chamber 32.

Hereinafter, operation of the heat exchanger washing device according to an exemplary embodiment of the present disclosure will be described in conjunction with the accompanying drawings.

Figure 7:
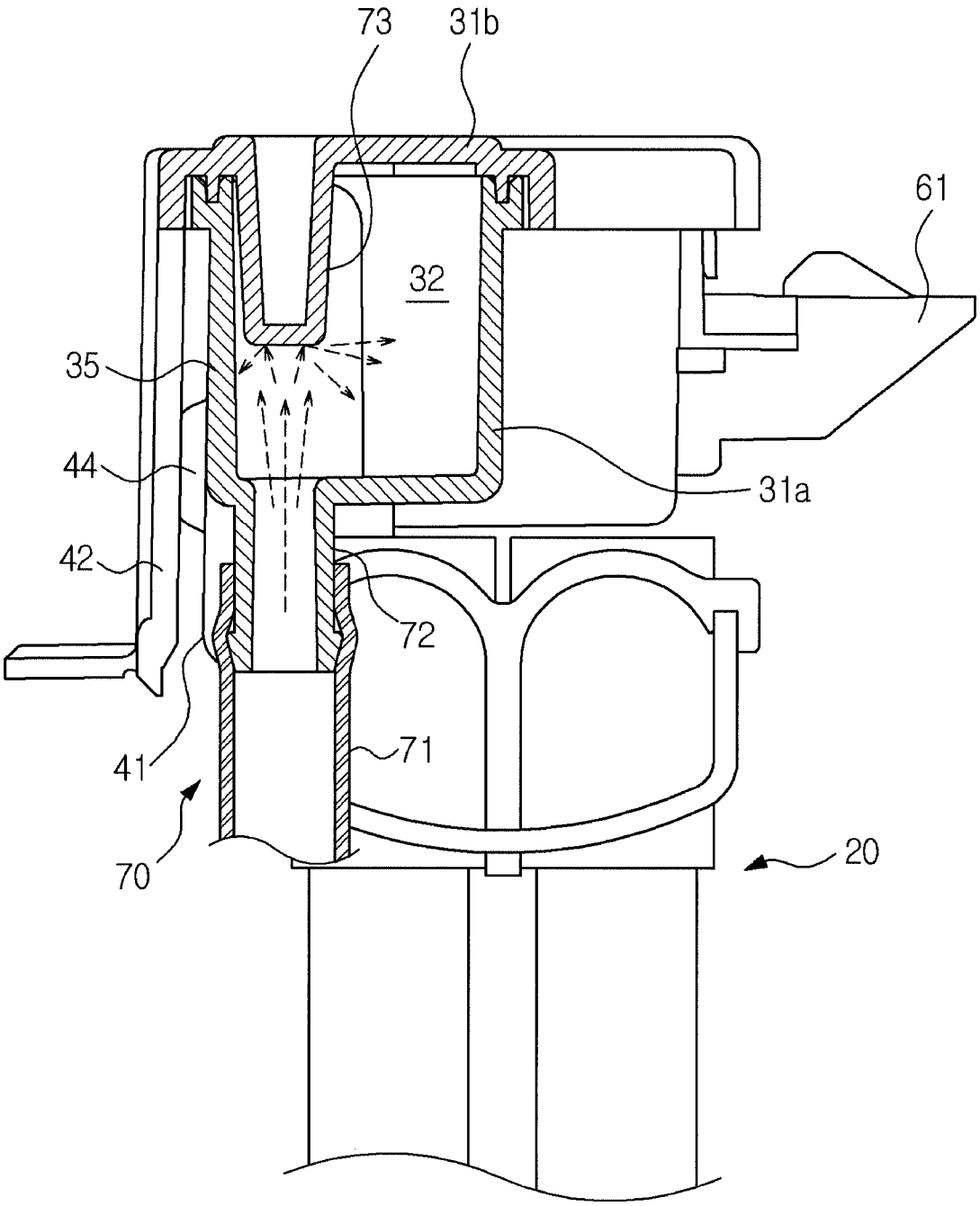
FIG. 7 is a view illustrating a water supply of the heat exchanger washing device according to an exemplary embodiment of the present disclosure.
Figure 8:
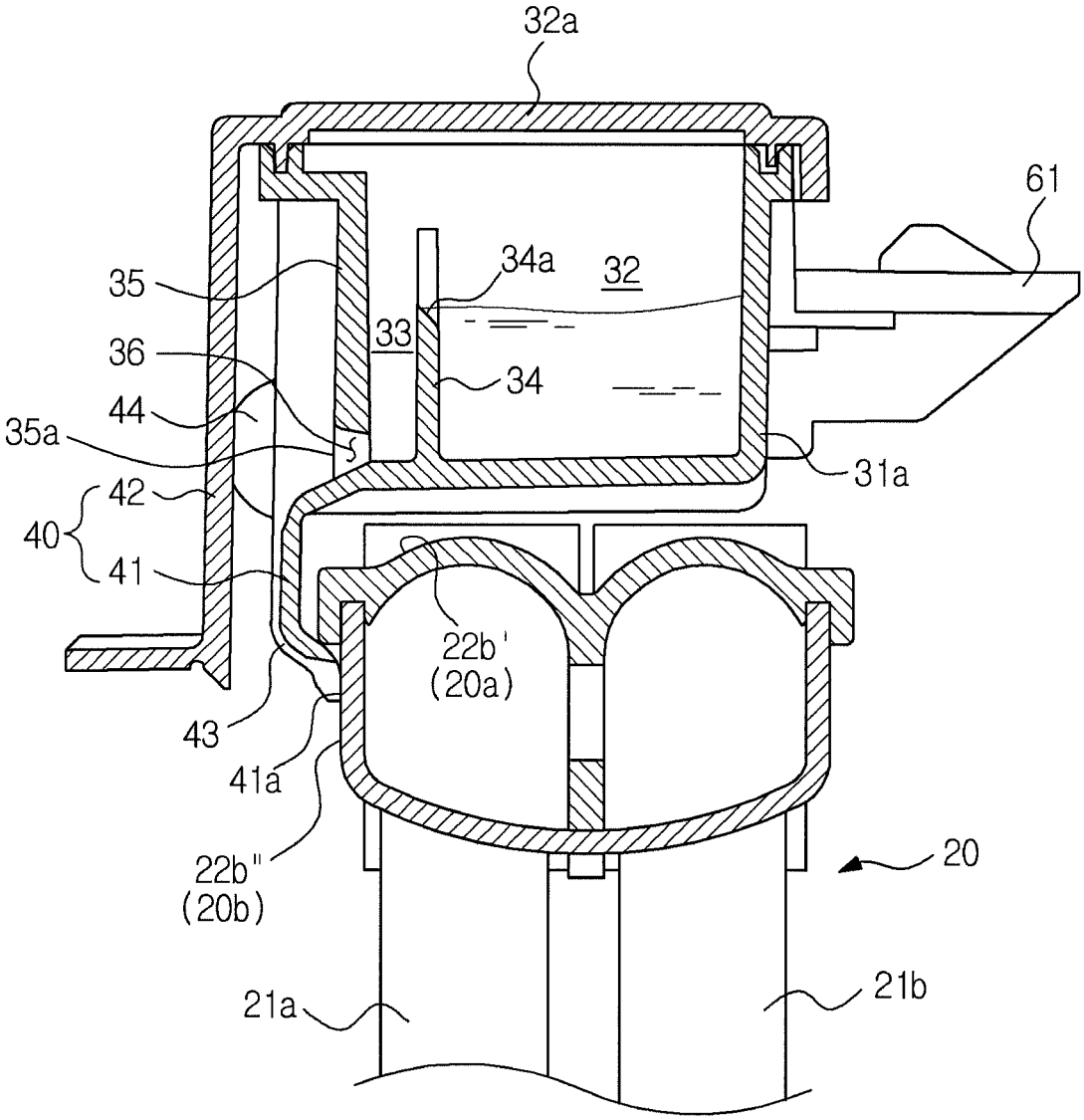
FIG. 8 is a view illustrating a storage state of the heat exchanger washing device according to an exemplary embodiment of the present disclosure.
Figure 9:
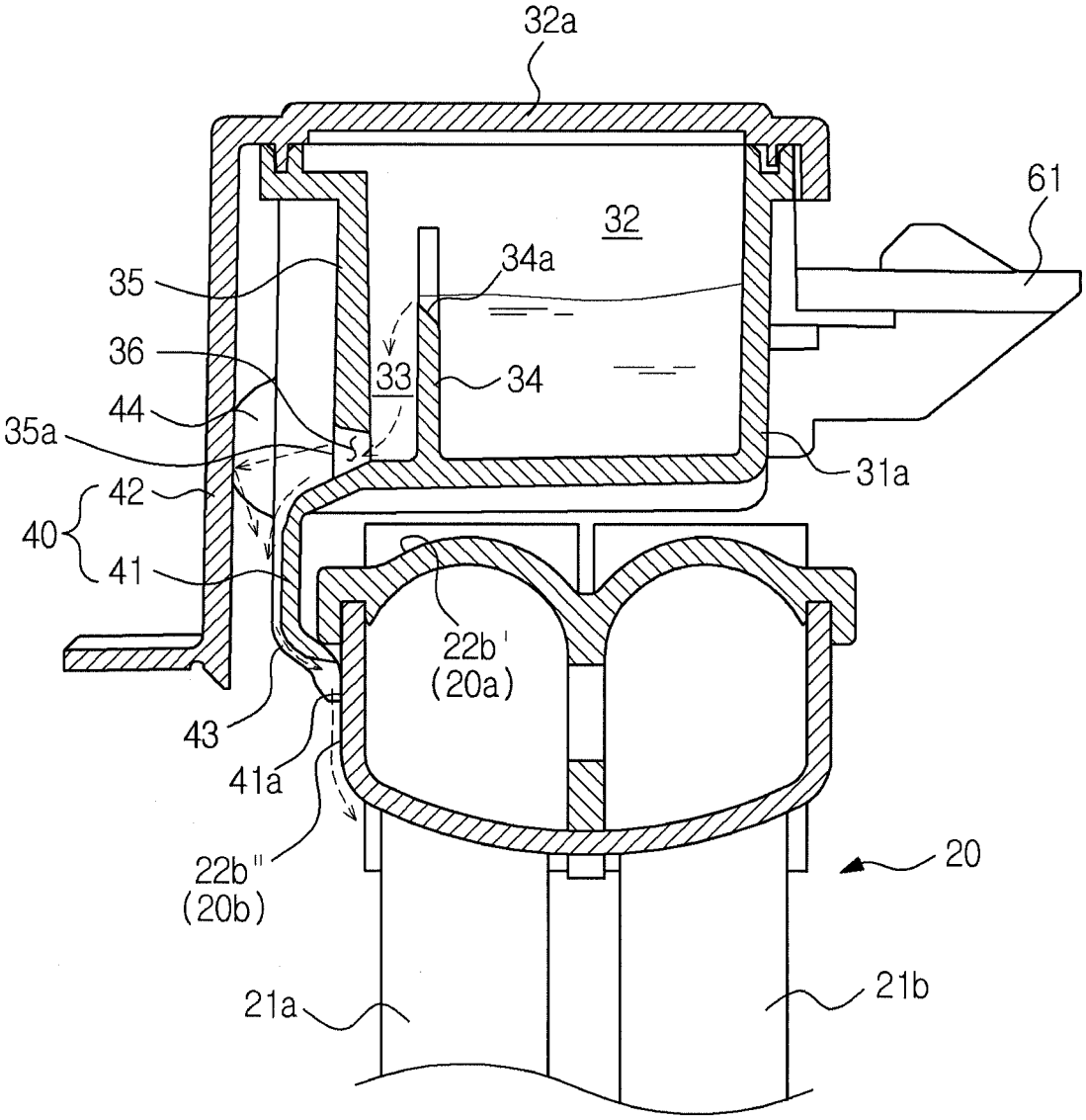
FIG. 9 is a view illustrating an injection operation and a bypassing operation of the heat exchanger washing device according to an exemplary embodiment of the present disclosure.

FIG. 7 is a view illustrating a water supply operation of the heat exchanger washing device according to an exemplary embodiment of the present disclosure. FIG. 8 is a view illustrating a storage state of the heat exchanger washing device according to an exemplary embodiment of the present disclosure. FIG. 9 is a view illustrating an injection operation and a bypassing operation of the heat exchanger washing device according to an exemplary embodiment of the present disclosure.

As shown in FIGS. 1 to 9, the heat exchanger washing device 30 pumps the wash water using the pump (not shown), as shown in FIG. 7. The wash water is subsequently ejected from the water supply member 72 through the connecting hose 71. The wash water ejected from the water supply member 72 is dispersed by the dispersion member 73, and is then stored in the wash water storage chamber 32. As a certain time elapses, the level of wash water stored in wash water storage chamber 32, as shown in FIG. 8, increases up to an upper end height of the first partition member 34.

Subsequently, the wash water stored in wash water storage chamber 32, as shown in FIG. 9, flows into the wash water injection chamber 33 over the first partition member 34. Since the first partition member 34 has an equal height along a longitudinal direction thereof, the wash water flows into the wash water injection chamber 33 over an entirety of the first partition member 34 along the longitudinal direction thereof. The wash water flowing into the wash water injection chamber 33 is supplied to the wash water nozzles 36 in equal quantity. The wash water is subsequently jetted through the wash water nozzles 36.

Thereafter, the wash water jetted through the wash water nozzles 36 is not supplied to the upper surface 22*b*' of the second header unit 22*b*, but is supplied to the side surface 22*b*" of the second header unit 22*b* by the first bypass path portion 41. Further, the second bypass path portion 42 blocks the wash water from being jetted in the direction away from the heat exchanger 20, and the wash water is guided to the first bypass path portion 41. The wash water subsequently flows along the plural flow guide portions 43 of the first bypass path portion 41.

Subsequently, the wash water flows down along the side surface 22*b*" of the second header unit 22*b*, and then flows down along the fins and tubes of the heat exchange unit 21. As a result, the fins and tubes of the heat exchange unit 21 may be washed clean.

As is apparent from the above description, a heat exchanger washing device and an air conditioner having the same according to the illustrated exemplary embodiments may clean a heat exchanger without directly jetting wash water to an upper end of the heat exchanger.

Also, since an equal quantity of wash water may be supplied throughout a longitudinal direction of the heat exchanger, washing performance of the heat exchanger may be uniformly maintained.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A heat exchanger washing device to clean a heat exchanger of an air conditioner, the heat exchanger washing device comprising:

a case including a bottom portion, an exterior surface of the bottom portion being shaped to couple to an upper surface of the heat exchanger;

a wash water storage chamber positioned in the case to store wash water;

a wash water injection chamber positioned in the case to jet the wash water received from the wash water storage chamber; and a bypass path unit coupled to the wash water injection chamber and comprising:

a first bypass path portion positioned at an area below where the jetted wash water exits the wash water injection chamber, the first bypass path portion extending to a side surface of the heat exchanger, when the heat exchanger is coupled to the exterior surface of the bottom portion of the case, after bypassing the upper surface of the heat exchanger; and a second bypass path portion, a side portion of which forms an exterior wall for the bypass path unit to define a space between the first bypass path portion and the second bypass path portion;

wherein the bypass path unit is configured to:

guide the jetted wash water from the wash water injection chamber outside the heat exchanger washing device through the space between the first bypass path unit and the second bypass path unit; and bypass, when the heat exchanger is coupled to the exterior surface of the bottom portion of the case and the heat exchanger washing device is operating, the upper surface of the heat exchanger to guide the jetted wash water to a side surface of the heat exchanger upon exiting the space between the first bypass path portion and the second bypass path portion.

2. The heat exchanger washing device according to claim 1, wherein:

the exterior surface of the bottom portion of the case of the heat exchange washing device ends at an edge of a header unit of the heat exchanger where the exterior surface adjoins the bypass path unit when the heat exchanger is coupled to the exterior surface of the bottom portion of the case of the heat exchange washing device, the heat exchanger comprises a heat exchange unit to allow refrigerant to exchange heat with air, and the header unit to supply the heat exchange unit with the refrigerant;

the upper surface of the heat exchanger corresponds to an upper surface of the header unit, and the side surface of the heat exchanger corresponds to a side surface of the header unit.

3. The heat exchanger washing device according to claim 1, wherein the case is configured to be located above the heat exchanger.

4. The heat exchanger washing device according to claim 1, wherein the case comprises a first case and a second case, which are coupled to each other, to define a certain space in the case.

5. The heat exchanger washing device according to claim 1, wherein at least one first partition member to divide the wash water storage chamber and at least one second partition member to divide the wash water injection chamber are formed in the case.

6. The heat exchanger washing device according to claim 5, wherein the first partition member is protruded from a first case, and an upper end of the first partition member is spaced apart from a second case.

7. The heat exchanger washing device according to claim 5, wherein the second partition member is protruded from the first case, and wash water nozzles are formed at a lower end of the second partition member.

8. The heat exchanger washing device according to claim 1, wherein an end of the bypass path unit is located at the side surface of the heat exchanger.

9. The heat exchanger washing device according to claim 1, wherein the second bypass path portion is spaced apart from the first bypass path portion by a predetermined clearance.

10. The heat exchanger washing device according to claim 9, wherein a plurality of flow guide portions is formed at the first bypass path portion to guide the wash water.

11. The heat exchanger washing device according to claim 1, further comprising:

a water supply unit to supply the wash water storage chamber with the wash water.

12. The heat exchanger washing device according to claim 11, wherein the water supply unit comprises:

a connecting hose to pass pumped wash water; and a water supply member connected to the connecting hose to supply the wash water storage chamber with the wash water.

13. The heat exchanger washing device according to claim 12, further comprising:

a dispersion member to disperse the wash water supplied through the water supply member, in order to store the wash water in the wash water storage chamber.

14. The heat exchanger washing device according to claim 13, wherein the water supply member is formed at a first case, and the dispersion member is formed in a second case and arranged above the water supply member.

15. The heat exchanger washing device according to claim 2, wherein the heat exchange unit comprises a plurality of fins and tubes.

16. A heat exchanger washing device to clean a heat exchanger of an air conditioner, the heat exchanger washing device comprising:

a case including a bottom portion, an exterior surface of the bottom portion being shaped to couple to an upper surface of the heat exchanger;

a wash water storage chamber to store wash water up to a predetermined level in the case;

a wash water injection chamber to jet the wash water received from the wash water storage chamber; and a bypass path unit coupled to the wash water injection chamber and comprising:

a first bypass path portion positioned at an area below where the jetted wash water exits the wash water injection chamber, the first bypass path portion extending to a side surface of the heat exchanger, when the heat exchanger is coupled to the exterior surface of the bottom portion of the case, after bypassing the upper surface of the heat exchanger; and a second bypass path portion, a side portion of which forms an exterior wall for the bypass path unit to define a space between the first bypass path portion and the second bypass path portion;

wherein the bypass path unit is configured to:

allow the jetted wash water from the wash water injection chamber outside the heat exchanger washing device through the space between the first bypass path unit and the second bypass path unit; and bypass at least one barrier arranged at an upper side of the heat exchanger upon exiting the space between the first bypass path portion and the second bypass path portion when the heat exchanger is coupled to the exterior surface of the bottom portion and the heat exchanger washing device is operating.

* * * * *